US005295454A

United States Patent [19]

Streck

[11] Patent Number: 5,295,454

[45] Date of Patent: Mar. 22, 1994

[54] SAFETY RELEASE OUTRIGGER ATTACHMENT FOR AN OUTRIGGER CANOE

[75] Inventor: Donald A. Streck, Kailua, Hi.

[73] Assignee: Showa Hatsumei Kaisha, Ltd., Kailua, Hi.

[21] Appl. No.: 33,584

[22] Filed: Mar. 18, 1993

[51] Int. Cl.[5] ..... B63B 43/14
[52] U.S. Cl. ..... 114/123
[58] Field of Search ..... 114/61, 121, 123, 126, 114/279

[56] References Cited

U.S. PATENT DOCUMENTS 4,716,847 1/1988 Wilson, Jr. ..... 114/61
4,875,426 10/1989 Soga et al. ..... 114/61
4,890,570 1/1990 Hofmeister ..... 114/123

*Primary Examiner*—Jesus D. Sotelo
*Attorney, Agent, or Firm*—Donald A. Streck

[57] ABSTRACT

Apparatus for releasably attaching an outrigger to a canoe so that the outrigger will release from the canoe rather than breaking the outrigger or the canoe. The inner ends of the outrigger yakus are attached to the canoe with a touch fastener material in shear so that the yakus are held firmly in place but will release under high shear forces on the touch fastener material.

16 Claims, 3 Drawing Sheets

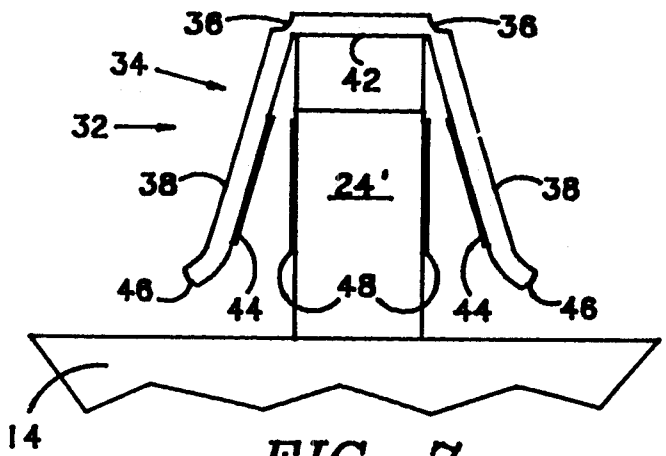
FIG. 7
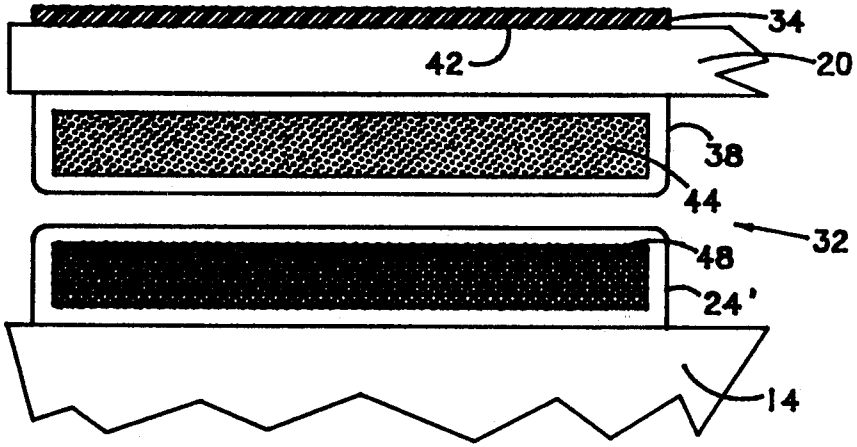
FIG. 6
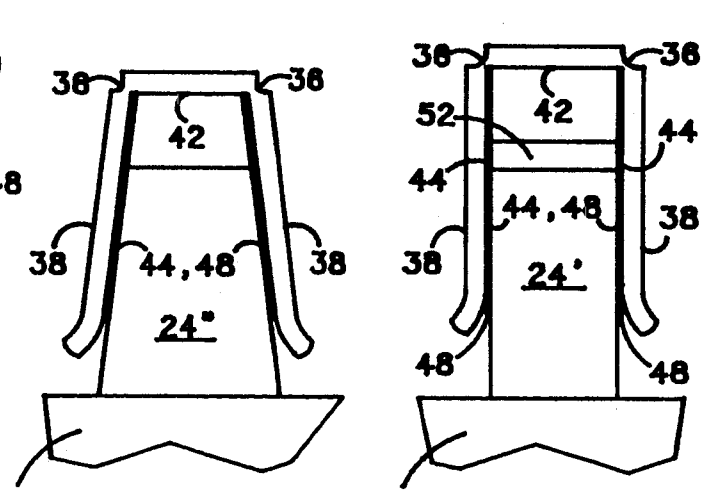
FIG. 11
FIG. 10
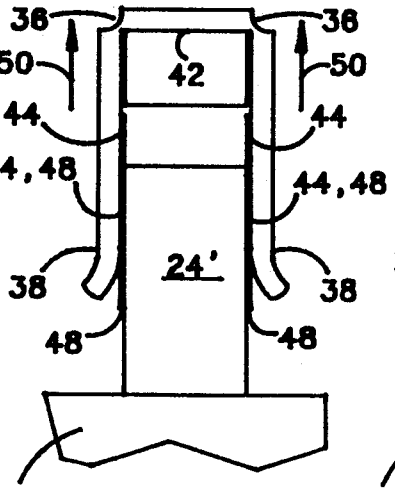
FIG. 9
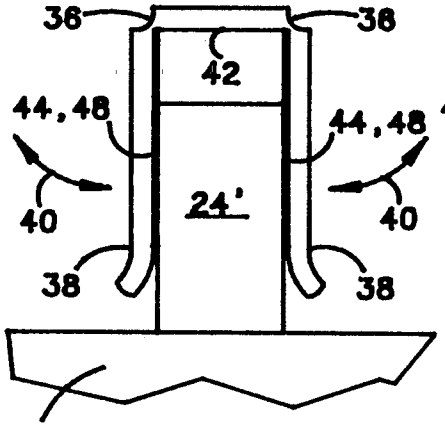
FIG. 8

SAFETY RELEASE OUTRIGGER ATTACHMENT FOR AN OUTRIGGER CANOE

BACKGROUND OF THE INVENTION

This invention relates to outrigger canoes and, more particularly, to a safety release for attaching an outrigger to a canoe. More specifically, it relates to a safety outrigger canoe comprising, a hull for carrying a paddler seated thereon; a pair of yakus disposed perpendicular to the hull each having an inner end and an outer end; an ama carried parallel to the hull by the outer end of each of the pair of yakus; and, safety release means for attaching and holding the inner end of each of the pair of yakus to the hull under normal conditions and for releasing the inner end of each of the pair of yakus from the hull when the ama is subjected to a force which would otherwise break the yakus.

Outrigger canoes are rapidly gaining popularity for sport and entertainment. Throughout the islands of the Pacific in particular, the outrigger canoe has long afforded a means of transportation not only for fishing and inter-island travel locally, but for travel over long distances as well. Such outrigger canoes come in all sizes from small one-man canoes to large canoes holding many paddlers.

More recently, one-man kayaks and canoes have been found to provide good exercise as well as good sport for health minded individuals. Thus, they are rapidly gaining in popularity. For good swimmers and more athletically inclined individuals, the kayak is very popular. Interest in ocean-going kayaking was stimulated in part by the popular Magnum P.I. television series which often featured the show's star, Tom Sellick, paddling his kayak in the beautiful waters of Hawaii.

An ocean-going kayak is long and of narrow beam. Thus, the user of a kayak must be fit and concentrate on what he/she is doing in order to prevent the kayak from rolling over and dumping the user in the water. Once in the water, a certain amount of skill is required to get back in the kayak in a paddling position. By contrast, a canoe fitted with an outrigger is much more stable and resistant to capsizing. Thus, it is more desirable for those of lesser skill or more interested in leisure activities requiring less concentration on the boat such as fishing, recreational paddling, or "surfing" the boat through waves.

As depicted in FIGS. 1 and 2, an outrigger canoe 10 having an outrigger 12 comprises a hull 14 upon which the paddler 16 sits and steers with a rudder 18 employing foot peddles (not shown). The outrigger 12 comprises a pair of yakus 20 attached to the hull 14 on one end and to an ama 22 on the other end. The outrigger 12 as depicted in the drawing figures is a single outrigger having only one ama 22. A double outrigger would have the yakus 20 extending in like manner on both sides of the hull 14 with amas 22 on both sides of the hull 14 to resist rolling in both directions. In early outrigger canoes, the yakus 20 were lashed to the hull 14 with rope or vines. Contemporary outrigger canoes are made of fiberglass and the yakus 20 are typically bolted to strongbacks 24 formed into the hull 14 employing stainless steel bolts 26.

As depicted in FIG. 2, if the canoe 10 becomes positioned broadside to a wave coming from the right as the figure is viewed, there will be a counter-clockwise capsizing force 28 exerted on the ama 22. If the paddler 16 does nothing, the canoe 10 will capsize. Not wishing to capsize, however, the paddler 16 will lean in the direction of the ama 22 to create a counteracting rotational force 30. If the force 28 is not too large, the counteracting force 30 will prevent the capsizing of the canoe 10 and nothing adverse will happen.

In a high wave situation such as encountered when taking the canoe 10 through the surf or when intentionally "surfing" the canoe 10, placing the canoe intentionally or inadvertently in a broadside situation can have more disastrous results as pictured in FIG. 3. The capsizing force 28 and the counteracting force 30 form a couple acting through the strongbacks 24 and the yakus 20. In anticipation of this, the original builder of the canoe is placed on the horns of a dilemma and regardless of the design choice made, the paddler 16 will be placed in a dangerous situation. The design choice is one of deciding what is to be the weakest link. If the yakus 20 are made stronger than the strongbacks 24, the strongbacks 24 will break requiring major reconstruction to the canoe 10. If the strongbacks 24 are made stronger than the yakus 20, the yakus 20 may break when not really necessary. While the yakus 20 are easier and less costly to replace, the problem is that when one or both yakus 20 breaks, the canoe cannot be used because rotational stability cannot be achieved even through concentration as is possible with a kayak since the paddler 16 sits on the top of a canoe as depicted in FIG. 1 rather than on the bottom as in a kayak. Thus, the paddler's center of gravity is too high for stability without the outrigger 12. If the outrigger 12 is broken in either manner described above and the paddler 16 is close to shore, it becomes a matter of inconvenience only unless the paddler 16 is a non-swimmer who should not have been out on a canoe in the first place. When further out, however, not being able to paddle the canoe back can present a serious problem for even a good swimmer.

The situation with outrigger canoes, therefore, is similar to that which existed not too many years ago with respect to ski equipment. When done mostly by experts, the skis were securely fastened to the skier's boots. In a bad fall that could not be avoided, the skier often broke leg bones because of the secure fastening of the skis to the boots which imparted sever forces to the leg bones in a fall. With the advent of skiing as a popular sport enjoyed by many people of differing skill levels, various forms of safety bindings which released the skis from the boots under extreme forces soon were invented and became popular.

Wherefore, it is the object of the present invention to provide a safety release attachment for the yakus to the canoe in an outrigger canoe or similar device.

SUMMARY

The foregoing object has been achieved in an outrigger canoe having a hull for carrying a paddler seat thereon, a pair of yakus disposed perpendicular to the hull each having an inner end and an outer end, and an ama carried parallel to the hull by the outer end of each of the pair of yakus, by the safety release means of the present invention for attaching and holding the inner end of each of the pair of yakus to the hull under normal conditions and for releasing the inner end of each of the pair of yakus from the hull when the ama is subjected to a force which would otherwise break the yakus comprising, a pair of parallel spaced strongbacks carried by the hull perpendicular to the hull; first releasable holding means carried by each of the pair of strongbacks; and, second releasable holding means carried by respective inner ends of the pair of yakus for interacting with the first releasable holding means to attach and hold the pair of yakus to the pair of strongbacks under normal conditions and release the inner end of each of the pair of yakus from an associated one of the pair of strongbacks when the ama is subjected to a force which would otherwise break the yakus.

In the preferred embodiment, the first releasable holding means comprises a first portion of a touch fastener material disposed on a substantially vertical surface of each of the pair of strongbacks; and, the second releasable holding means comprises, a member having a substantially vertical surface carried by the inner end of each of the pair of yakus, and a second and mating portion of the touch fastener material disposed on the vertical surface of each member whereby the safety release means must overcome an in-shear holding force of the touch fastener material to release.

It is also preferred that each of the pair of strongbacks has a pair of substantially parallel and vertical surfaces having a strip of the first portion of the touch fastener material attached thereto; each of the pair of yakus is disposed on a top surface of an associated one of the pair of strongbacks; and, each member comprises a pair of wings having a strip of the second portion of the touch fastener material attached thereto, the pair of wings being hingedly moveable between a first position substantially parallel and vertical with the first portion of the touch fastener material mated in-shear with the second and mating portion of the touch fastener material and a second position with the first portion of the touch fastener material disengaged from the second and mating portion of the touch fastener material.

Preferably, each member is a plastic U-shaped member disposed over an associated one of the pair of yakus and having the pair of wings extending from respective ones of a pair of living hinges disposed at a back portion thereof.

For adjustability, shim means are disposed between each of the pair of yakus and the top surface of the associated one of the pair of strongbacks whereby an overlapped area of the first portion of the touch fastener material and the second and mating portion of the touch fastener material is reduced to correspondingly lower the in-shear holding force of the touch fastener material required to release the safety release means.

DESCRIPTION OF THE DRAWINGS

FIG. 6 is a partially cutaway sideview drawing of the safety release apparatus of the present invention.

FIG. 7 is an endview drawing of the safety release apparatus of the present invention with the moveable wings raised for normal attachment or removal of the associated yaku.

FIG. 8 is an endview drawing of the safety release apparatus of the present invention with the moveable wings in their closed position holding the associated yaku in place on the canoe.

FIG. 9 is an endview drawing of the safety release apparatus of the present invention with the moveable wings in their closed position for holding the associated yaku in place on the canoe in the process of pulling apart under extreme force to release the yaku.

FIG. 10 is an endview drawing of the safety release apparatus of the present invention showing a first modification wherein the touch fastener material is placed in semi-shear to increase its ability to release when required.

FIG. 11 is an endview drawing of the safety release apparatus of the present invention showing a second modification wherein a shim is placed between the yaku and the strongback to decrease the overlap of the touch fastener material and thereby decrease the force required release.

DESCRIPTION OF THE PREFERRED EMBODIMENT

Figure 1:
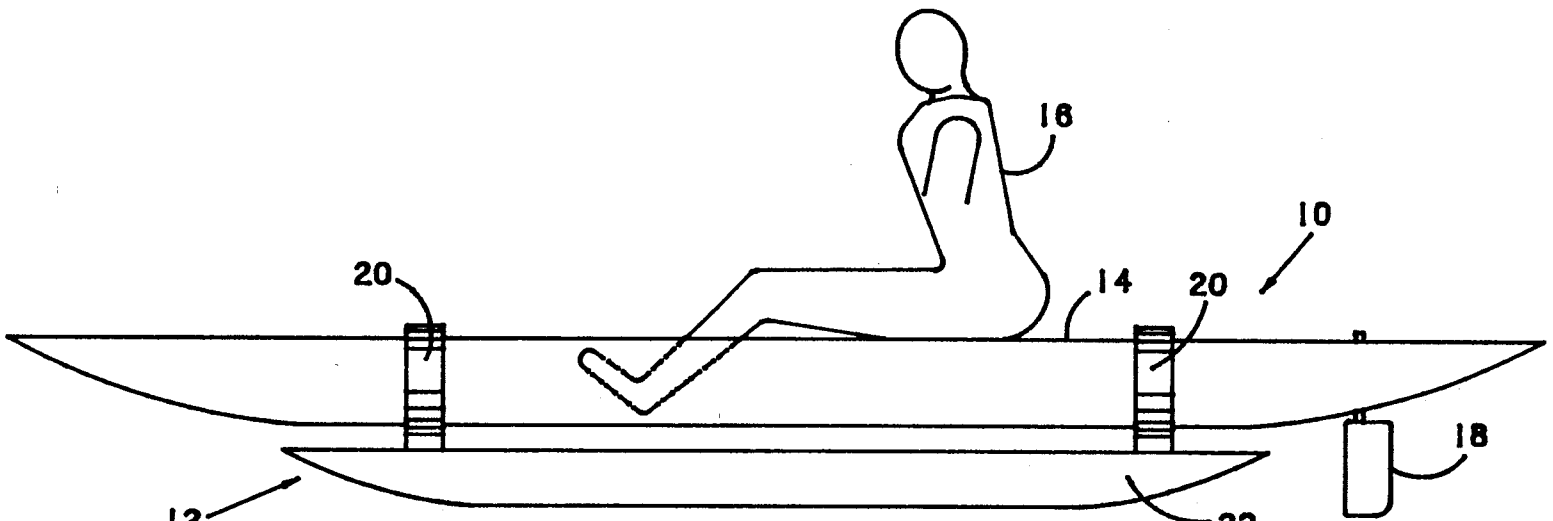
FIG. 1 PRIOR ART
FIG. 1 is a simplified side view of a prior art outrigger canoe.
Figure 2:
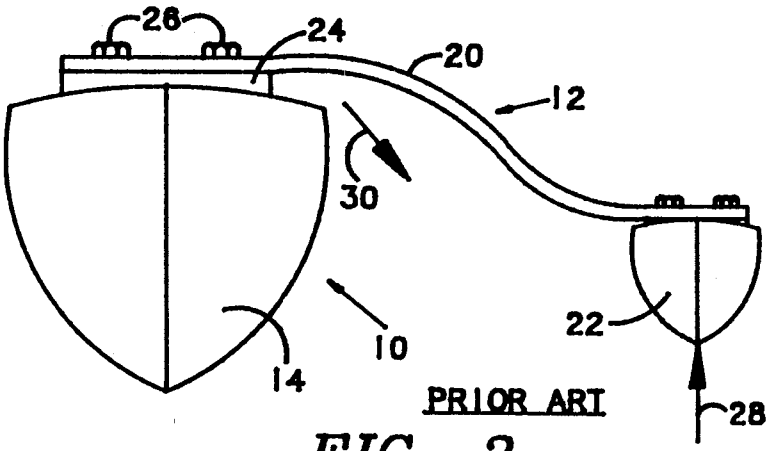
FIG. 2 PRIOR ART
FIG. 2 is an enlarged simplified front view of the outrigger canoe of FIG. 1.
Figure 3:
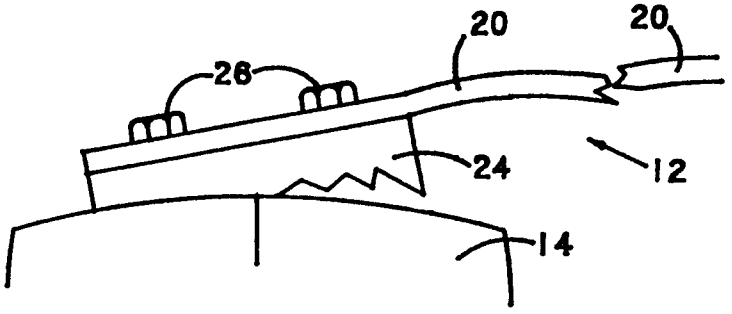
FIG. 3 PRIOR ART
FIG. 3 is a further enlarged simplified front view of the outrigger canoe of FIG. 2 at the point where the outrigger yaku is attached to the canoe showing results of excessive force when the yaku is securely attached to the canoe.
Figure 4:
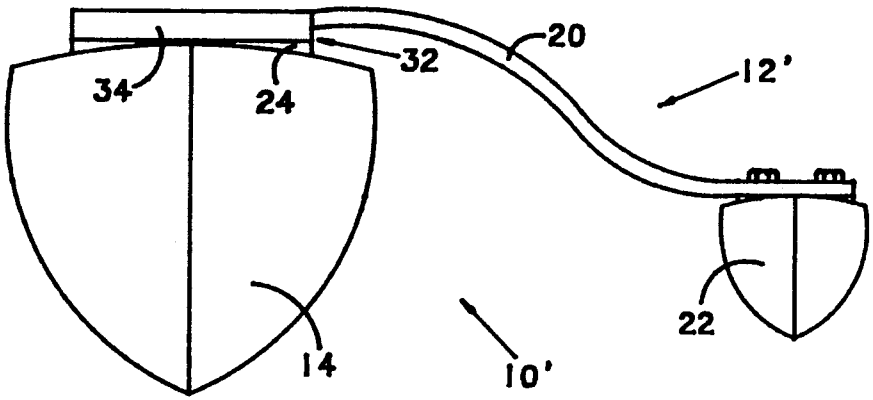
FIG. 4 is an enlarged simplified front view of an outrigger canoe according to the present invention with the outrigger in place for use.
Figure 5:
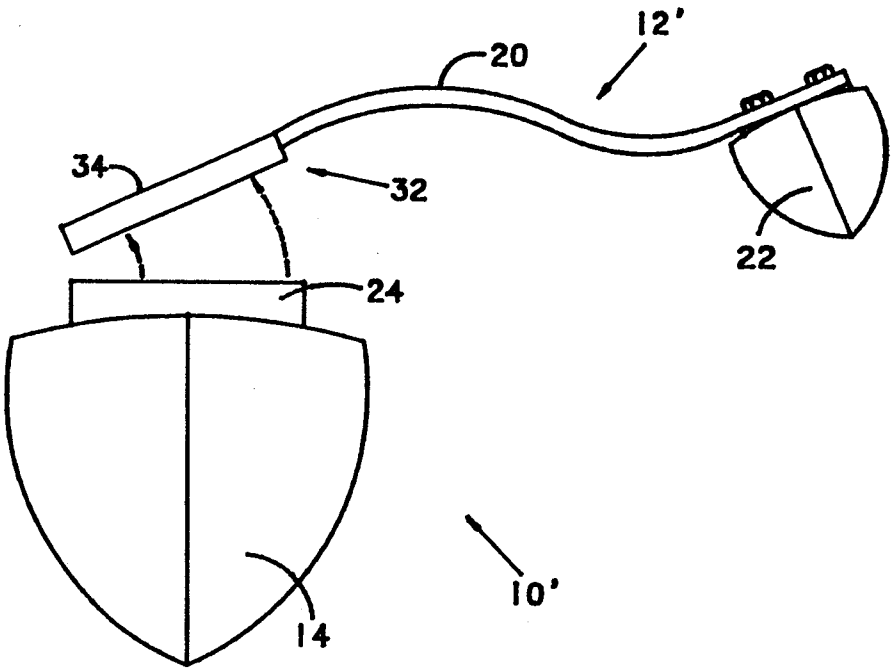
FIG. 5 is an enlarged simplified front view of an outrigger canoe according to the present invention with the outrigger in the process of releasing from excessive force which otherwise would have caused damage to the canoe and/or outrigger.

An outrigger canoe 10' according to the present invention is depicted in FIGS. 4 and 5. While a single outrigger is shown, those skilled in the art will recognize and appreciate that the same approach can be accomplished with a double outrigger. In the canoe 10', everything is virtually the same with one exception. The yakus 20 are not bolted to the strongbacks 24. Rather, they are releasably held in place by a safety release attachment 32 which will be described in detail shortly. As depicted in FIG. 4, when in normal use the outrigger 12' functions just as the prior art outrigger 12. As depicted in FIG. 5, however, when a capsizing force on the safety release attachments 32 exceeds a pre-established amount, the safety release attachments 32 pull off of the strongbacks 24 without breakage to either the canoe 10' or the outrigger 12'. The paddler can then reattach the outrigger 12' from the water and then reboard and use the canoe 10' as if nothing happened.

The construction of the safety release attachment 32 of the present invention in its preferred embodiment is depicted in FIGS. 6–9. While other approaches to a release attachment of the yaku 20 to the strongback 24 could undoubtedly be accomplished within the scope and spirit of the present invention, several factors make the depicted approach the preferred approach. For one, the materials are light in weight so as not to have heavy pieces flying about which could strike and injure the paddler. For another, the materials are cheap so as not to add substantially to the cost of the canoe. Finally, there are no metal parts to rust in the saltwater environment where most outrigger canoe operate.

The heart and basis for operation of the safety release attachment 32 is the use of a touch fastener material such as that sold under the tradename Velcro "in shear". Touch fastener material consists of a hook portion and a loop portion. The hook portion is a flexible plastic material having small hooks over its mating surface. The loop portion is a wool-like fabric material which is actually comprised of a series of small fiber loops. When pressed together, the hooks become entangled with the loops thereby holding the two portions securely together. The two portions are most resistive to being parted along their parallel surfaces or in shear. They are most easily parted by rolling them apart along their length so that they come apart perpendicularly one row of hooks at a time. Since the hook portion is of a flexible plastic material, the hooks disengage from the loops by flexing and literally unhooking from the loops. If this were not the case and the hooks were solid, the loops would have to break to release the hooks and the touch fastener material would soon lose its usefulness. Since the plastic material of the hook portion is typically some strong plastic with good memory qualities such as Nylon, touch fastener material has a very long life expectancy even under repeated use.

As will be noted in the above description of the touch fastener material's manner of construction and operation, the material is "most resistive" to being parted in shear. It is not completely resistive. Since the hooks must be flexed to unhook them from the loops, the amount of force required to separate the two portions in shear is in direct proportion to the number of hooks that must be flexed into release simultaneously. As will be remembered, the normal releasing motion is one of peeling which releases the hooks row by row. Releasing in shear requires that all rows of hooks release simultaneously. Thus, the amount of force required to release a touch fastener material will be a function of two things—the toughness of the hooks and the area of the material in contact. The toughness of the hooks has to do with whether the touch fastener material is a light weight version intended for light duty such as holding light clothing fabric together or a heavy weight version intended for heavy duty such as holding canvas awning material together.

With the foregoing in mind and turning to FIGS. 6–9, the safety release attachment 32 comprises a generally U-shaped portion 34 of a tough plastic material such as Nylon having so-called living hinges at 36 so that the wings 38 can be moved easily as indicated by the arrows 40 in FIG. 8. For maximum strength the U-shaped design is employed with the yaku 20 being held into the closed end of the "U" with an adhesive at 42. While not preferred, the U-shaped portion 34 could be replaced by a pair of wings attached to the sides of the yakus 20. The inside of each of the two wings 38 has a strip of one-half of the touch fastener material adhesively attached to it. Preferably, it is the hook portion 44. It is also preferred that the touch fastener material be a heavy weight version with an adhesive backing as such materials adhere to a smooth surface such as a plastic surface with great tenacity and, therefore, should not require any other type of fastening to prevent the touch fastener material from coming off. As shown in the drawing figures, it is preferred that the wings 38 be of a thickness and material so as to have some degree of flexibility and that the bottom edges at 46 be curved outward so that the fingers of a user can be placed underneath the wing edges. This manner of construction makes it easier to remove the outrigger 12' for storage or transportation without effecting it performance of the safety release attachment 32 under either normal or abnormal (i.e. safety release) use.

Strips of the other one-half of the touch fastener material are adhesively attached to the outer vertical parallel surfaces of a strongback 24'. Preferably, it is the loop portion 48. As best seen in FIGS. 7 and 8, the strips of hook portion 44 and loop portion 48 are in vertical alignment when the yaku 20 is positioned on the top of the strongback 24'. To mount the outrigger 12' employing the safety release attachment 32 of the present invention, the wings 38 are moved outward and the yaku 20 is placed on top of the strongback 24' as depicted in FIG. 7. The wings 38 are then closed to have the hook portion 44 and loop portion 48 engage one another as depicted in FIG. 8. The hook portion 44 and loop portion 48 of the touch fastener material are the placed in an in-shear position with respect to resisting removal of the yaku 20 from the strongback 24'.

When a force 50 on the safety release attachment 32 exceeds the shear resistive force of the engaged hook portion 44 and loop portion 48 of the touch fastener material, the safety release attachment 32 separates in shear (i.e. with the wings 38 remaining in their closed state of FIG. 8) as depicted in FIG. 9. The shear resistive force of the engaged hook portion 44 and loop portion 48 of the touch fastener material is a function of several factors which can be set at the time of building or adjusted by the user depending on the conditions to be encountered. The type of touch fastener material (e.g. light weight, medium weight, heavy weight) is one factor which is determined by the builder. The amount of area in contact can be determined in part by the builder as a function of the length and width of the strips of materials 44,48 employed. As depicted in FIG. 11, the amount of area in contact and thereby the release force can be adjusted by placing a plastic adjusting shim 52 between the yaku 20 and the top of the strongback 24'. As in skiing, under normal use it might be desired to have the outrigger 12' separate from the canoe 10' under a lower force to prevent a rollover from a broadside wave whereas under competition conditions, it would be preferred to have the outrigger 12' separate from the canoe 10' only under a force about to break the yaku 20. Thus, in normal use the adjusting shim 52 would be used to reduce the overlap and thereby the force required for separation while in competition the shim would be removed for maximum overlap and separation force.

Another modification that can be made if the materials employed produce a shear release force which is too high is depicted in FIG. 10. By slightly narrowing the top of the strongback 24'' as compared to its base, the touch fastener material is place in a semi-in-shear state. As can be appreciated, the closer to parallel the two sidewalls 54 of the strongback 24'' are, the closer to being in-shear the touch fastener material will be and the more out of parallel, the closer the touch fastener material will be to being subjected to a peeling type of separation force (which, of course, is much lower).

As those skilled in the art will undoubted have realized, the principle of the present invention can be employed to releasably hold any two members together so as to release from one another when a separating force on the members exceeds the in-shear force on the touch fastener material holding them together. For example, if made small as for example with the mating surfaces in the order of one inch square, the present invention could be configured as a safety joiner for a cord or leash which would separate before breaking the cord or causing damage to something attached thereto if the separating force on the joiner became greater than the in-shear holding force of the touch fastener material.

Wherefore, having thus described the present invention,

What is claimed is:

1. A safety outrigger canoe comprising:

a) a hull for carrying a paddler seated thereon;

b) a pair of yakus disposed perpendicular to said hull each having an inner end and an outer end;

c) an ama carried parallel to said hull by said outer end of each of said pair of yakus; and, d) safety release means for attaching and holding said inner end of each of said pair of yakus to said hull under normal conditions and for releasing said inner end of each of said pair of yakus from said hull when said ama is subjected to a force which would otherwise break said yakus.

2. The safety outrigger canoe of claim 1 wherein said safety release means comprises:

a) a pair of parallel spaced strongbacks carried by said hull perpendicular to said hull;

b) first releasable holding means carried by each of said pair of strongbacks; and, c) second releasable holding means carried by respective inner ends of said pair of yakus for interacting with said first releasable holding means to attach and hold said pair of yakus to said pair of strongbacks under normal conditions and for releasing said inner end of each of said pair of yakus from an associated one of said pair of strongbacks when said ama is subjected to a force which would otherwise break said yakus.

3. The safety outrigger canoe of claim 2 wherein:

a) said first releasable holding means comprises a first portion of a touch fastener material disposed on a substantially vertical surface of each of said pair of strongbacks; and, b) said second releasable holding means comprises, b1) a member having a substantially vertical surface carried by said inner end of each of said pair of yakus, and b2) a second and mating portion of said touch fastener material disposed on said vertical surface of each said member whereby said safety release means must overcome an in-shear holding force of said touch fastener material to release.

4. The safety outrigger canoe of claim 3 wherein:

a) each of said pair of strongbacks has a pair of substantially parallel and vertical surfaces having a strip of said first portion of said touch fastener material attached thereto;

b) each of said pair of yakus is disposed on a top surface of an associated one of said pair of strongbacks; and, c) each said member comprises a pair of wings having a strip of said second portion of said touch fastener material attached thereto, said pair of wings being hingedly moveable between a first position substantially parallel and vertical with said first portion of said touch fastener material mated in-shear with said second and mating portion of said touch fastener material and a second position with said first portion of said touch fastener material disengaged from said second and mating portion of said touch fastener material.

5. The safety outrigger canoe of claim 4 wherein:

each said member is a plastic U-shaped member disposed over an associated one of said pair of yakus and having said pair of wings extending from respective ones of a pair of living hinges disposed at a back portion thereof.

6. The safety outrigger canoe of claim 4 and additionally comprising:

shim means disposed between each of said pair of yakus and said top surface of said associated one of said pair of strongbacks whereby an overlapped area of said first portion of said touch fastener material and said second and mating portion of said touch fastener material is reduced to correspondingly lower said in-shear holding force of said touch fastener material required to release said safety release means.

7. In an outrigger canoe having a hull for carrying a paddler seated thereon, a pair of yakus disposed perpendicular to said hull each having an inner end and an outer end, and an ama carried parallel to the hull by the outer end of each of the pair of yakus, safety release means for attaching and holding the inner end of each of the pair of yakus to the hull under normal conditions and for releasing the inner end of each of the pair of yakus from the hull when the ama is subjected to a force which would otherwise break the yakus comprising:

a) a pair of parallel spaced strongbacks carried by the hull perpendicular to the hull;

b) first releasable holding means carried by each of the pair of strongbacks; and, c) second releasable holding means carried by respective inner ends of the pair of yakus for interacting with said first releasable holding means to attach and hold the pair of yakus to said pair of strongbacks under normal conditions and release the inner end of each of the pair of yakus from an associated one of said pair of strongbacks when the ama is subjected to a force which would otherwise break the yakus.

8. The safety release means for an outrigger canoe of claim 7 wherein:

a) said first releasable holding means comprises a first portion of a touch fastener material disposed on a substantially vertical surface of each of said pair of strongbacks; and, b) said second releasable holding means comprises, b1) a member having a substantially vertical surface carried by the inner end of each of the pair of yakus, and b2) a second and mating portion of said touch fastener material disposed on said vertical surface of each said member whereby the safety release means must overcome an in-shear holding force of said touch fastener material to release.

9. The safety release means for an outrigger canoe of claim 8 wherein:

a) each of said pair of strongbacks has a pair of substantially parallel and vertical surfaces having a strip of said first portion of said touch fastener material attached thereto;

b) each of the pair of yakus is disposed on a top surface of an associated one of said pair of strongbacks; and, c) each said member comprises a pair of wings having a strip of said second portion of said touch fastener material attached thereto, said pair of wings being hingedly moveable between a first position substantially parallel and vertical with said first portion of said touch fastener material mated in-shear with said second and mating portion of said touch fastener material and a second position with said first portion of said touch fastener material disengaged from said second and mating portion of said touch fastener material.

10. The safety release means for an outrigger canoe of claim 9 wherein:

each said member is a plastic U-shaped member disposed over an associated one of the pair of yakus and having said pair of wings extending from respective ones of a pair of living hinges disposed at a back portion thereof.

11. The safety release means for an outrigger canoe of claim 9 and additionally comprising:

shim means disposed between each of the pair of yakus and said top surface of said associated one of said pair of strongbacks whereby an overlapped area of said first portion of said touch fastener material and said second and mating portion of said touch fastener material is reduced to correspondingly lower said in-shear holding force of said touch fastener material required to release the safety release means.

12. Safety release means for use in an outrigger canoe having a hull for carrying a paddler seated thereon, a pair of yakus disposed perpendicular to said hull each having an inner end and an outer end, and an ama carried parallel to the hull by the outer end of each of the pair of yakus, to attach and hold the inner end of each of the pair of yakus to the hull under normal conditions and release the inner end of each of the pair of yakus from the hull when the ama is subjected to a force which would otherwise break the yakus comprising:

a) a pair of parallel spaced strongbacks carried by the hull perpendicular to the hull;

b) first releasable holding means carried by each of the pair of strongbacks, said first releasable holding means comprises a first portion of a touch fastener material disposed on a substantially vertical surface of each of said pair of strongbacks; and, c) second releasable holding means carried by respective inner ends of the pair of yakus for interacting with said first releasable holding means to attach and hold the pair of yakus to said pair of strongbacks under normal conditions and release the inner end of each of the pair of yakus from an associated one of said pair of strongbacks when the ama is subjected to a force which would otherwise break the yakus, said second releasable holding means comprising, c1) a member having a substantially vertical surface carried by the inner end of each of the pair of yakus, and c2) a second and mating portion of said touch fastener material disposed on said vertical surface of each said member whereby the safety release means must overcome an in-shear holding force of said touch fastener material to release.

13. The safety release means for an outrigger canoe of claim 12 wherein:

a) each of said pair of strongbacks has a pair of substantially parallel and vertical surfaces having a strip of said first portion of said touch fastener material attached thereto;

b) each of the pair of yakus is disposed on a top surface of an associated one of said pair of strongbacks; and, c) each said member comprises a pair of wings having a strip of said second portion of said touch fastener material attached thereto, said pair of wings being hingedly moveable between a first position substantially parallel and vertical with said first portion of said touch fastener material mated in-shear with said second and mating portion of said touch fastener material and a second position with said first portion of said touch fastener material disengaged from said second and mating portion of said touch fastener material.

14. The safety release means for an outrigger canoe of claim 13 wherein:

each said member is a plastic U-shaped member disposed over an associated one of the pair of yakus and having said pair of wings extending from respective ones of a pair of living hinges disposed at a back portion thereof.

15. The safety release means for an outrigger canoe of claim 13 and additionally comprising:

shim means disposed between each of the pair of yakus and said top surface of said associated one of said pair of strongbacks whereby an overlapped area of said first portion of said touch fastener material and said second and mating portion of said touch fastener material is reduced to correspondingly lower said in-shear holding force of said touch fastener material required to release the safety release means.

16. Safety release apparatus for releasably joining a pair of members against opposed separating forces comprising:

a) a first member having a pair of inward-facing spaced surfaces parallel to a direction of the separating forces, said first member being a plastic U-shaped member having said pair of wings extending from respective ones of a pair of living hinges disposed at a back portion thereof;

b) first releasable holding means carried by each of said pair of inward-facing spaced surfaces, said first releasable holding means comprising a first portion of a touch fastener material;

c) a second member having a pair of outward-facing spaced surfaces parallel to said direction of the separating forces, said second member being disposed with said pair of outward-facing spaced surfaces disposed between said pair of inward-facing spaced surfaces, said second member being a flat member disposed between said pair of wings; and, d) second releasable holding means carried by said pair of outward-facing spaced surfaces, said second releasable holding means comprising a second portion of said touch fastener material, said first portion of said touch fastener material and said second portion of said touch fastener material being mated together and in shear with respect to said separating forces acting on said first member and said second member whereby the safety release means must overcome an in-shear holding force of said touch fastener material in order to release.

* * * * *